US011707414B2

(12) United States Patent
Yang et al.

(10) Patent No.: US 11,707,414 B2
(45) Date of Patent: Jul. 25, 2023

(54) SEALED ASSEMBLY FOR PILL CRUSHING AND DELIVERING AND METHOD FOR USING THEREOF

(71) Applicant: Song Yang, Shanghai (CN)

(72) Inventors: Song Yang, Shanghai (CN); Hongliang Tian, Changshu (CN)

(73) Assignee: Song Yang, Shanghai (CN)

( * ) Notice: Subject to any disclaimer, the term of this patent is extended or adjusted under 35 U.S.C. 154(b) by 332 days.

(21) Appl. No.: 17/140,132

(22) Filed: Jan. 4, 2021

(65) Prior Publication Data

US 2021/0378915 A1 Dec. 9, 2021

(30) Foreign Application Priority Data

Nov. 8, 2019 (CN) ..... 201911086672.8

(51) Int. Cl.
*A61J 7/00* (2006.01)

(52) U.S. Cl.
CPC ..... *A61J 7/0007* (2013.01)

(58) Field of Classification Search
CPC ..... A61J 7/0007; A61J 1/2051
USPC ..... 241/DIG. 27
See application file for complete search history.

(56) References Cited

U.S. PATENT DOCUMENTS 4,568,331 A * 2/1986 Fischer ..... A61J 7/0007 604/518
6,358,236 B1 3/2002 DeFoggi et al.
2005/0123485 A1 6/2005 Suzuki
2010/0168712 A1* 7/2010 Tuckwell ..... A61J 1/2096 604/416
2013/0226100 A1* 8/2013 Lev ..... A61J 1/2096 604/246

(Continued)

FOREIGN PATENT DOCUMENTS

CN 205386240 U 7/2016
CN 205683303 U 11/2016

(Continued)

OTHER PUBLICATIONS

1st Office Action dated Apr. 21, 2022 of Chinese Application No. 201911086672.8.

*Primary Examiner* — Shelley M Self
*Assistant Examiner* — Jared O Brown
(74) *Attorney, Agent, or Firm* — Qinghong Xu

(57) ABSTRACT

A sealed assembly for pill crushing and delivering and a method for using thereof are provided. The assembly includes: a connecting valve with different diameters, including a first end, a valve and a second end provided with a syringe-abutting interface, wherein, an opening diameter of the first end is larger than that of the second end; and a pill-crushing carrier including a sealed cavity having only one filling-in opening, the pill-crushing carrier has a first state when separated from the connecting valve and the filling-in opening is exposed for delivering pills into the carrier, and a second state when the filling-in opening is connected to the first end of the connecting valve, crushed and dissolved pill powders in the sealed cavity can be taken out through the connecting valve. The assembly can crush pills and dissolve powders in a sealed cavity, deliver powder-dissolved liquid and prevent powders from dispersing.

12 Claims, 27 Drawing Sheets

(56) References Cited

U.S. PATENT DOCUMENTS

| | | | | |
|---|---|---|---|---|
| 2015/0083950 | A1* | 3/2015 | Okiyama | A61J 1/2082<br>251/148 |
| 2015/0209233 | A1* | 7/2015 | Fukuoka | A61J 1/2096<br>604/411 |
| 2015/0290448 | A1* | 10/2015 | Pavlik | A61J 1/201<br>604/533 |
| 2016/0058662 | A1* | 3/2016 | Wheeler | A61J 7/0007<br>206/530 |
| 2016/0354282 | A1* | 12/2016 | Macy, Jr. | A61J 7/0007 |
| 2018/0333332 | A1 | 11/2018 | Abusbeih | |
| 2022/0226196 | A1* | 7/2022 | Hadad | A61J 7/0007 |

FOREIGN PATENT DOCUMENTS

| | | | |
|---|---|---|---|
| CN | 106377430 | A | 2/2017 |
| CN | 206934350 | U | 1/2018 |
| CN | 209490271 | U | 10/2019 |
| JP | H06154290 | A | 6/1994 |

* cited by examiner

SEALED ASSEMBLY FOR PILL CRUSHING AND DELIVERING AND METHOD FOR USING THEREOF

CROSS-REFERENCE TO RELATED APPLICATIONS

This application is based upon and claims priority to Chinese Patent Application No. 201911086672.8, filed on Nov. 8, 2019, the entire contents of which are incorporated herein by reference.

TECHNICAL FIELD

The present disclosure relates to a medical auxiliary device, and more particularly to a sealed assembly for pill crushing and delivering and a method for using thereof.

BACKGROUND

Medicine can be delivered to human body in many ways. For example, the medicine can be taken orally, by intravenous injection, intramuscular injection, or hypodermic injection, etc. The forms of the medicine taken mainly includes pills, medicament, medicine mist, etc. Wherein, the tablet medicine is a common oral preparation in medical field formed by certain molding process with a uniform mixture of medicine and supplementary material, and in a circular shape or a heteromorphic shape. The tablet medicine has the advantages of high accuracy of dosage, convenience to carry and transport, etc.

Although in some cases liquid preparation can be used, some medicine may be hard to be made to liquid preparation. Therefore, this kind of medicine can only be made to tablet medicine or round pill medicine and taken orally. For some patients who have troubles in swallow or have a stomach tube or an enteral nutrition pipeline, it's hard to take the medicine orally by themselves, then the tablet medicine or round pill medicine can be crushed or smashed into powders, dissolved to liquid and suctioned by a syringe, then the medicine can be delivered adjunctively to the mouth, the digestive tract, or the enteral nutrition pipeline in an injection form.

In the prior art, a pill grinding device uses a way of impact crushing, pounding with a hammer, or grinding, etc. to crush the pills. Theses ways normally need large forces. Besides, during the process of the pill crushing, pouring the powders into a container to dissolve and mix well, etc., the powders, the environment and people are in a mutual opening and exposing state, and a risk of mutual contamination may occur. For example, during the process, some of the powders may disperse to the air or to the table, and may cause potential damage to the health of medical workers or other patients. The environment and people may also cause contamination to powders or powder-dissolved injection liquid. Therefore, how to prevent the pill from leakage during the whole crushing process and prevent the residual pill powders after pill crushing from dispersing has become a main problem of this pill delivering way. Furthermore, this pill delivering way should also prevent the pill coatings or fragments generated by incomplete pill crushing from blocking the syringe or the enteral nutrition pipeline, which will cause a medicine waste, inconvenience to reposition a guiding tube or even some dangerous situations.

SUMMARY

In the present disclosure, a sealed assembly for pill crushing and delivering and a method for using thereof are provided. The sealed assembly includes: a connecting valve with different diameters, comprising a first end and a second end along a connecting direction of the connecting valve, wherein, the second end is provided with a syringe-abutting interface, an opening diameter of the first end is larger than an opening diameter of the second end, and a valve is provided between the first end and the second end, to block or connect fluid communication between the first end and the second end; and a pill-crushing carrier at least comprising a sealed cavity, wherein the sealed cavity is provided with only one filling-in opening for delivering pills into the sealed cavity, the pill-crushing carrier has a first state and a second state, when in the first state, the pill-crushing carrier is separated from the connecting valve and the filling-in opening is exposed for delivering pills into the sealed cavity, when in the second state, the filling-in opening is connected to the first end of the connecting valve, crushed and dissolved pill powders in the sealed cavity can be taken out from the second end of the connecting valve.

A method for using a sealed assembly for pill crushing and delivering includes the following steps:

separating the pill-crushing carrier and the connecting valve, and filling in at least one pill through the filling-in opening of the pill-crushing carrier;

screwing the filling-in opening of the pill-crushing carrier to the connecting valve, keeping the valve closed to seal the pill-crushing carrier;

crushing the pill in the pill-crushing carrier into powders;

connecting a syringe to the second end of the connecting valve, opening the valve, and pushing the injection liquid from the syringe to the pill-crushing carrier, to dissolve the powders;

extracting powder-dissolved injection liquid from the pill-crushing carrier using the syringe, and then separating the pill-crushing carrier and the connecting valve.

Another method for using a sealed assembly for pill crushing and delivering includes the following steps:

placing at least one pill on the support filter screen;

screwing the filling-in opening of the pill-crushing carrier to the connecting valve, clamping the support filter screen loaded with the pill between the pill-crushing carrier and the connecting valve, and keeping the valve closed;

rotating the pill-crushing carrier and the connecting valve back and forth alternately to make the grinding boss of the connecting valve grind the pill, the powders falling into the pill-crushing carrier through the filling-in opening;

connecting a syringe to the second end of the connecting valve, opening the valve, and pushing the injection liquid from the syringe to the pill-crushing carrier, to dissolve the powders;

extracting powder-dissolved injection liquid from the pill-crushing carrier using the syringe, and then separating the pill-crushing carrier and the connecting valve.

It should be readily understood that both the foregoing general description and the following detailed description are exemplary and explanatory only, and are not intended as a limitation to the scope of the present disclosure.

BRIEF DESCRIPTION OF THE DRAWINGS

The foregoing and other features, and advantages of the invention are apparent from the following detailed description taken in conjunction with the accompanying drawings in which.

DETAILED DESCRIPTION

In the following, embodiments of the present disclosure will be described in detail with reference to the figures. The concept of the present disclosure can be implemented in a plurality of forms, and should not be understood to be limited to the embodiments described hereafter. In contrary, these embodiments are provided to make the present disclosure more comprehensive and understandable, and so the conception of the embodiments can be conveyed to those skilled in the art fully. Same reference signs in the figures refer to same or similar elements, so repeated description of them will be omitted.

Besides, the technical features, assemblies, and characteristics can be combined in any appropriate way in one or more embodiments. In the following, more specific details are provided to give a full understanding to the embodiments of the present disclosure. However, those skilled in the art should realize that the technical proposal can also be realized without one or more of the specific details, or with other assemblies or components. In other conditions, some common assemblies or components well known in the art are not described to avoid making the present disclosure unclear.

Figure 1:
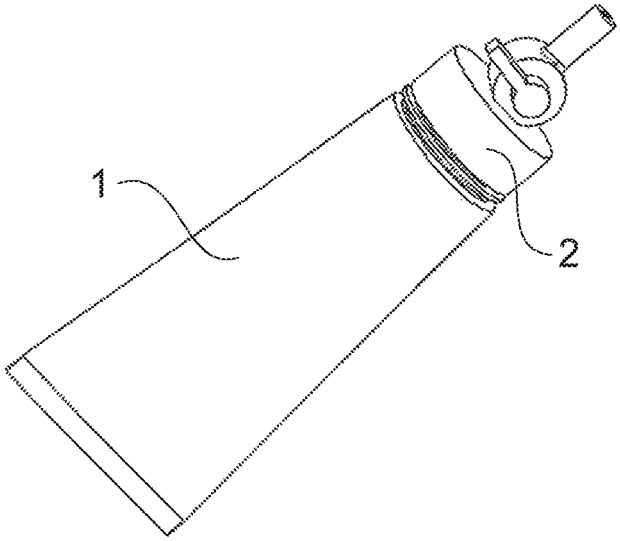
FIG. 1 is a stereogram of a first kind of sealed assembly for pill crushing and delivering of the present disclosure.
Figure 2:
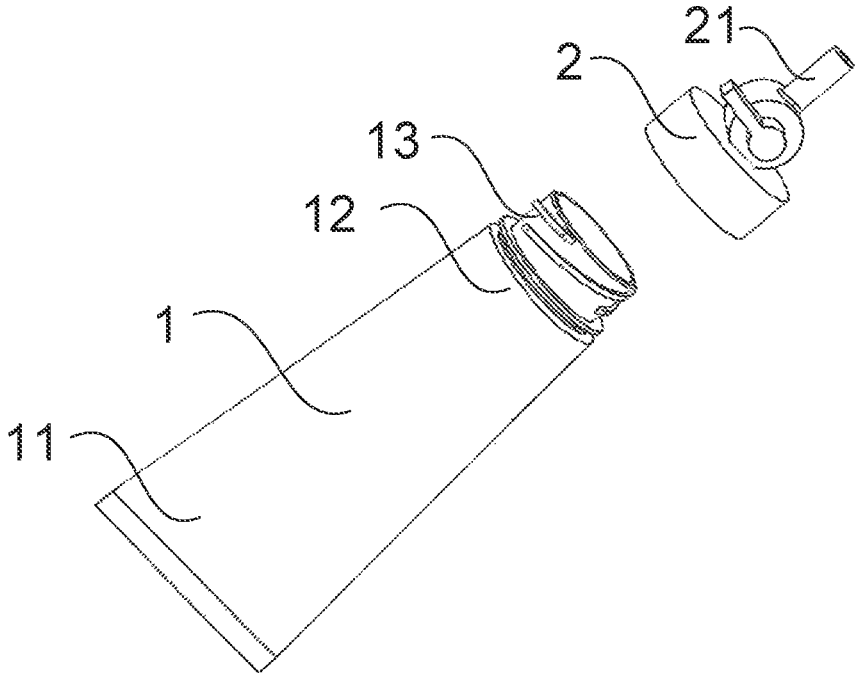
FIG. 2 is a decomposition view of the first kind of sealed assembly for pill crushing and delivering of the present disclosure.
Figure 3:
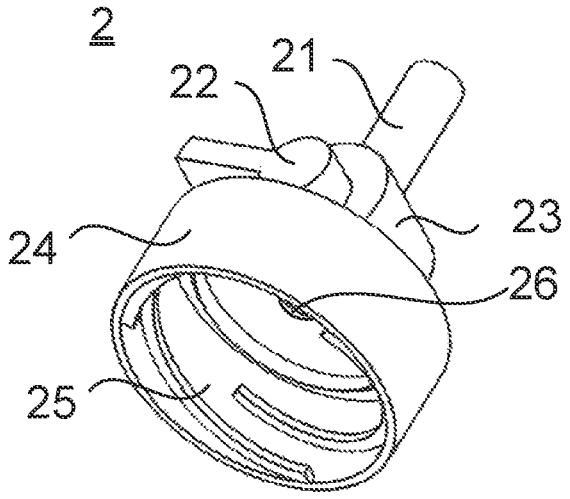
FIG. 3 is a stereogram of a connecting valve of the first kind of sealed assembly for pill crushing and delivering of the present disclosure.
Figure 8:
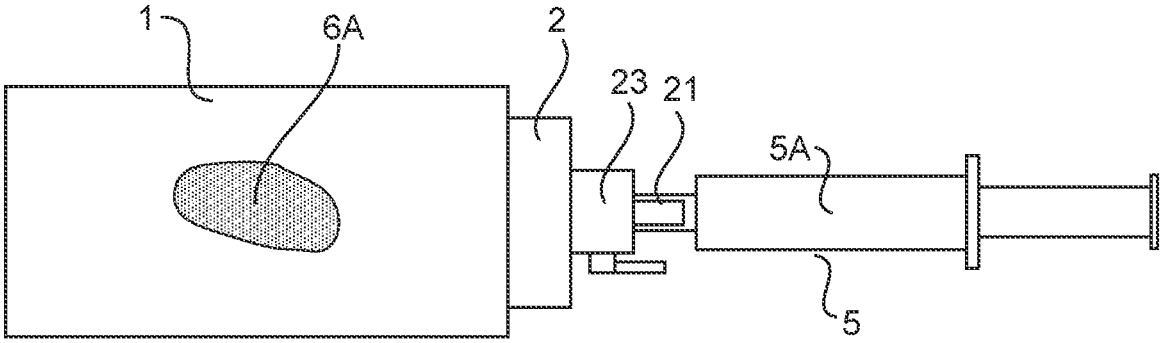
FIG. 8 is a schematic view of the first kind of sealed assembly for pill crushing and delivering when a syringe is connected, of the present disclosure.

FIG. 1 is a stereogram of a first kind of sealed assembly for pill crushing and delivering of the present disclosure. FIG. 2 is a decomposition view of the first kind of sealed assembly for pill crushing and delivering of the present disclosure. FIG. 3 is a stereogram of a connecting valve of the first kind of sealed assembly for pill crushing and delivering of the present disclosure. As shown in FIGS. 1, 3 and 8, the first kind of sealed assembly for pill crushing and delivering of the present disclosure includes a pill-crushing carrier 1, a connecting valve 2 with different diameters, a syringe 5 and a pill crusher (not shown in the FIGS.). The connecting valve 2 includes a first end and a second end along a connecting direction of the connecting valve 2. The second end of the connecting valve 2 is provided with a syringe-abutting interface 21. An opening diameter of the first end is larger than an opening diameter of the second end. A valve 23 is provided between the first end and the second end, to block or connect fluid communication between the first end and the second end. The pill-crushing carrier 1 includes a flexible sealed cavity for crushing the pill to powders. The sealed cavity is provided with only one filling-in opening for delivering pills into the sealed cavity. The pill-crushing carrier 1 has a first state and a second state. When in the first state, the pill-crushing carrier 1 is separated from the connecting valve 2 and the filling-in opening is exposed for delivering pills into the sealed cavity, meanwhile, the filling-in opening can also be an outlet for directly pouring out the powders after the pill is crushed. When in the second state, the filling-in opening is connected to the first end of the connecting valve 2, liquid is injected to the sealed cavity from the second end of the connecting valve 2 to dissolve the powders and powder-dissolved injection liquid can be extracted out from the sealed cavity. Therefore, the filling-in opening has two different functions in the first state and the second state, respectively. In the first state, the filling-in opening is used for delivering pills into the sealed cavity, which is the first function of the filling-in opening. In the second state, the filling-in opening is used as a channel for delivering injection liquid from the syringe to the pill-crushing carrier 1 or extracting the injection liquid from the pill-crushing carrier 1 to the syringe, which is the second function of the filling-in opening. The injected liquid can be water, physiological saline, or other suitable liquid. The syringe 5 is abutted with the syringe-abutting interface 21, the injection liquid in the syringe 5 flows into or out of the pill-crushing carrier 1 through the connecting valve 2. The pill crusher is used to press the pill-crushing carrier 1 loaded with the pill. The cooperate state of the pill-crushing carrier 1 and the connecting valve 2 of the present disclosure ensures not any part of powders disperse into the air during the pill crushing process, prevents harmful powders from damaging the health of medical workers or other patients. The pill-crushing carrier 1 can be sealed after used to ensure no leakage of residual pill powders after crushed.

The pill-crushing carrier 1 of the present disclosure only includes one filling-in opening, so the sealing ability of the pill-crushing carrier 1 is best ensured. A diameter of the filling-in opening is larger, so the solid pill with a large size can be filled in the pill-crushing carrier 1 (normally a diameter of this kind of pill is much larger than an opening diameter of the syringe). When the filling-in opening is connected to the connecting valve 2, as the diameter of the second end of the connecting valve 2 is smaller enough to connect to the syringe, the function of the filling-in opening is changed. After connected to the connecting valve 2, the filling-in opening is used as a channel for delivering injection liquid from the syringe to the pill-crushing carrier 1 or extracting the injection liquid from the pill-crushing carrier 1 to the syringe. Therefore, the present disclosure realizes the effect of using one opening as two different states and two different functions.

The syringe-abutting interface 21 of the present disclosure can be any kind of connectors used for a syringe that are already invented or will be invented in the future. The connector can be a male connector or female connector, so that the connecting valve 2 of the present disclosure can be connected to any kind of syringe. But the present disclosure is not limited to this.

In a preferable embodiment, the first end of the connecting valve 2 is a cap-shaped structure. An inner wall of a peripheral of an inner threaded interface 24 is provided with inner thread 25, and a through hole 26 connected to the second end of the connecting valve 2 is provided in a center of the inner threaded interface 24. But the present disclosure is not limited to this.

In a preferable embodiment, along the connecting direction of the connecting valve 2, an inner wall of the connecting valve 2 is provided with a filter screen 27 for filtering out pill fragments. The filter screen 27 is integrally formed with the connecting valve 2, and located between the valve 23 and the first end of the connecting valve 2. The filter screen 27 can filter out the residual pill fragments generated by incomplete pill crushing, and block the pill fragments in the connecting valve 2, to prevent the pill fragments from falling into the syringe 5 and blocking the syringe.

In a preferable embodiment, a periphery of the filling-in opening is provided with an outer threaded interface 13. An inner wall of the first end of the connecting valve 2 is provided with an inner threaded interface 24 screwed to the outer threaded interface 13. But the present disclosure is not limited to this.

In a preferable embodiment, the pill-crushing carrier 1 is an extrusion tube in a shape of a toothpaste tube (for example: a plastic soft tube body). The pill-crushing carrier of the embodiment can also be a thin-wall plastic tube body, a bag body or a bottle body, formed by blow molding, vacuum molding or injection molding, the pill-crushing carrier can also be a glass bottle body, the present disclosure is not limited to this. The extruding tube includes a sealed side 11 and an opening side 12 opposite of the sealed side 11. The opening side 12 is provided with the filling-in opening, and an opening direction of the filling-in opening is the same as an extruding direction of the extruding tube, but the present disclosure is not limited to this.

In a preferable embodiment, an axial direction of the first end of the connecting valve is the same as an axial direction of the second end of the connecting valve, but the present disclosure is not limited to this.

In the present disclosure, the solid pill can be crushed, dissolved and transferred to the syringe in a same sealed cavity, the risk caused by mutual exposure among the pill, the environment and people is reduced. there is no need to transfer the pill to other containers, instead, the pill is crushed, dissolved and used in a same sealed space, the dose integrity of the pill can be ensured to the greatest extent and the residual parts of the pill are reduced. The powders being delivered to the syringe realizes abutting to a common connection interface in modern medical treatment, such as a connection interface of an oral syringe, an enteral nutrition syringe, a stomach tube, an enteral nutrition pipeline or other kinds of standard connection interfaces or connectors. The pill can be taken orally or delivered to enteral system in an injection form, to fulfill the requirements of special groups or patients. Especially during the entire process of pill crushing, dissolving and pill solution transferring, the pill crushing and the pill dissolving in the liquid are performed in a same sealed system with the delivering and using of the pill solution, the potential risk of contamination of the environment to the pill is reduced, the potential risk of contamination and damage of the pill, especially the powders and the pill solution to the environment and people is reduced.

Figure 4:
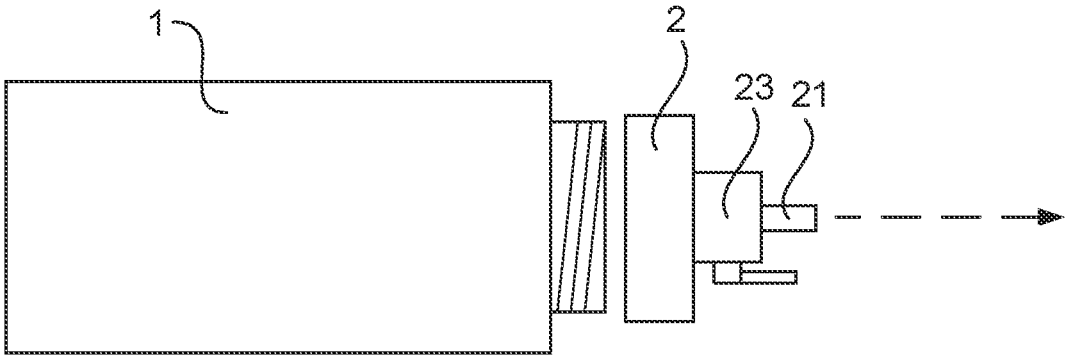
FIG. 4 is a schematic view of the first kind of sealed assembly for pill crushing and delivering in a separated state, of the present disclosure.
Figure 5:
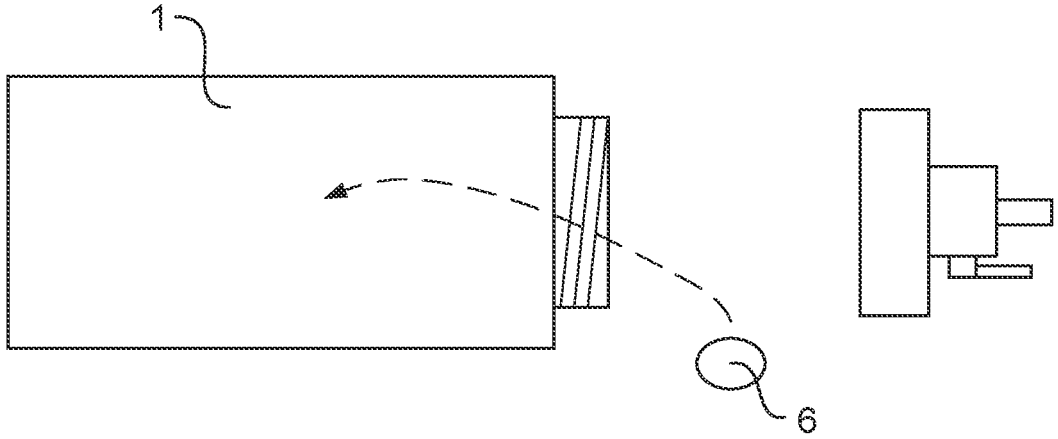
FIG. 5 is a schematic view of the first kind of sealed assembly for pill crushing and delivering when the pill is filled in after the assembly is in the separated state, of the present disclosure.
Figure 6:
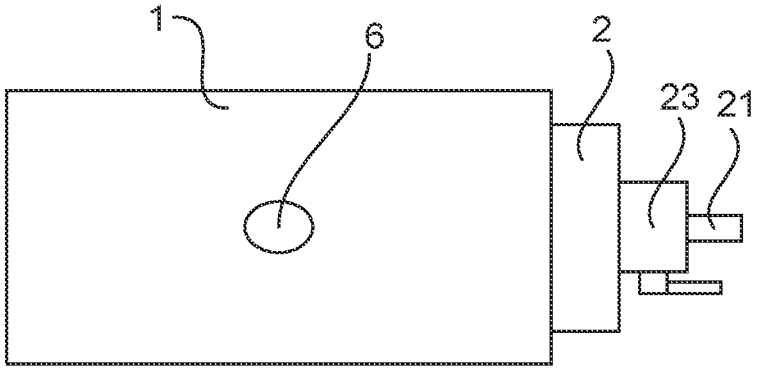
FIG. 6 is a schematic view of the first kind of sealed assembly for pill crushing and delivering when the pill is sealed in the pill-crushing carrier, of the present disclosure.
Figure 7:
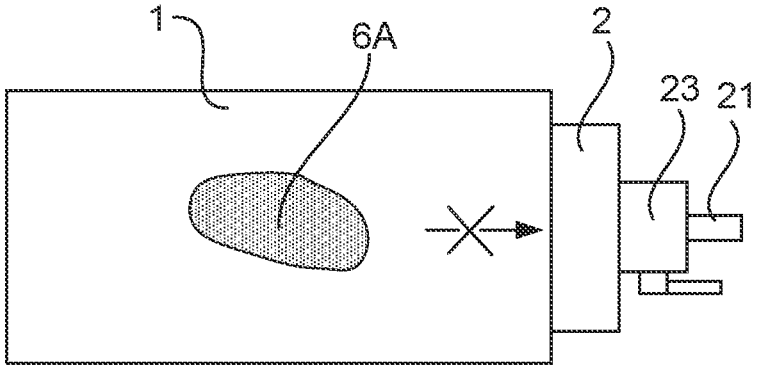
FIG. 7 is a schematic view of the first kind of sealed assembly for pill crushing and delivering when the pill is crushed, of the present disclosure.
Figure 9:
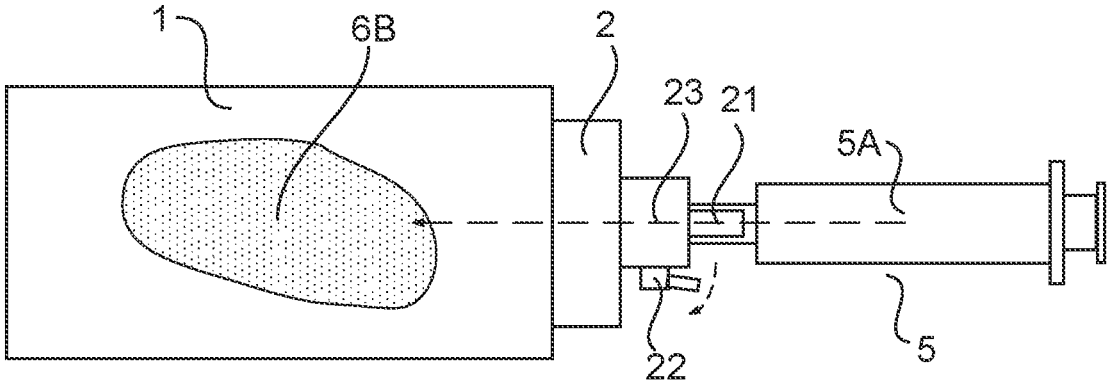
FIG. 9 is a schematic view of the first kind of sealed assembly for pill crushing and delivering when injection liquid is injected in to dissolve powders after the syringe is connected, of the present disclosure.

FIG. 4 is a schematic view of the first kind of sealed assembly for pill crushing and delivering in a separated state, of the present disclosure. FIG. 5 is a schematic view of the first kind of sealed assembly for pill crushing and delivering when the pill is filled in after the assembly is in the separated state, of the present disclosure. FIG. 6 is a schematic view of the first kind of sealed assembly for pill crushing and delivering when the pill is sealed in the pill-crushing carrier, of the present disclosure. FIG. 7 is a schematic view of the first kind of sealed assembly for pill crushing and delivering when the pill is crushed, of the present disclosure. FIG. 8 is a schematic view of the first kind of sealed assembly for pill crushing and delivering when a syringe is connected, of the present disclosure. FIG. 9 is a schematic view of the first kind of sealed assembly for pill crushing and delivering when injection liquid is injected to dissolve the powders after the syringe is connected, of the present disclosure.

Figure 10:
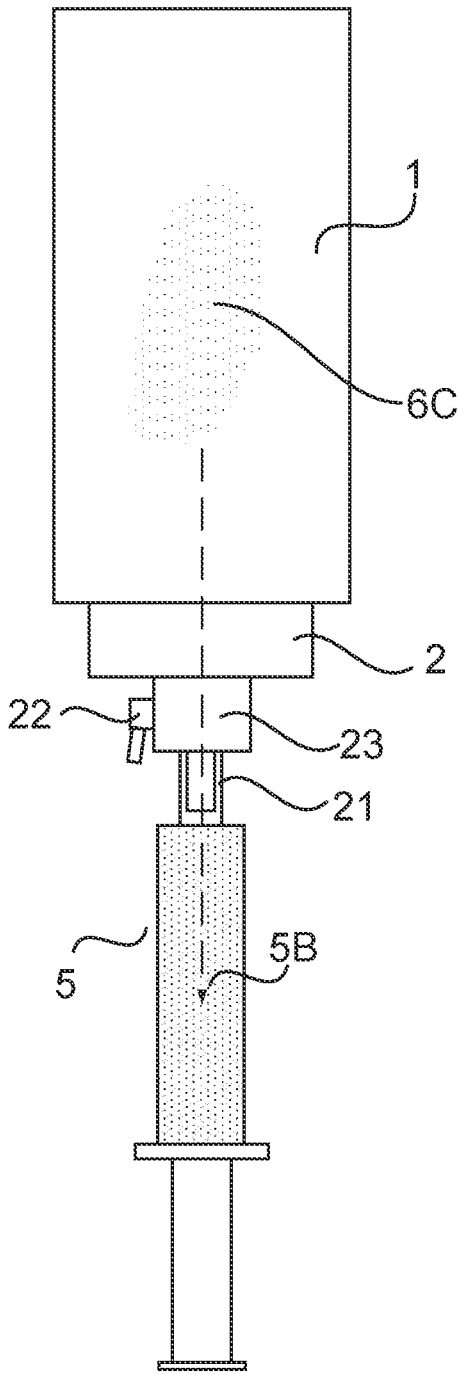
FIG. 10 is a schematic view of the first kind of sealed assembly for pill crushing and delivering when powder-dissolved injection liquid is extracted using the syringe, of the present disclosure.
Figure 11:
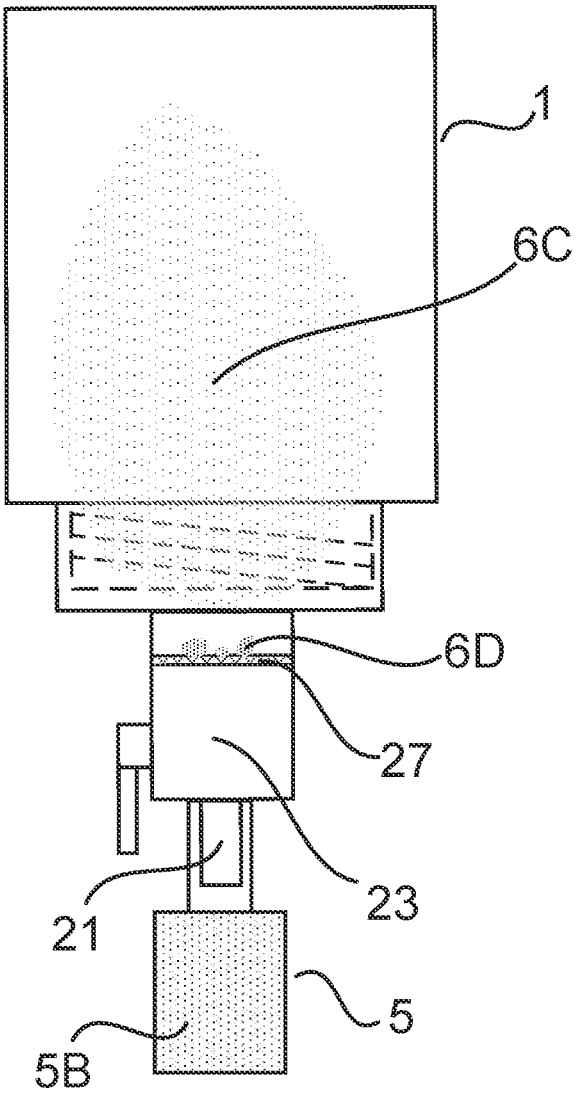
FIG. 11 is a schematic view of the first kind of sealed assembly for pill crushing and delivering when a filter screen filters out pill fragments during the extraction of the injection liquid, of the present disclosure.
Figure 12:
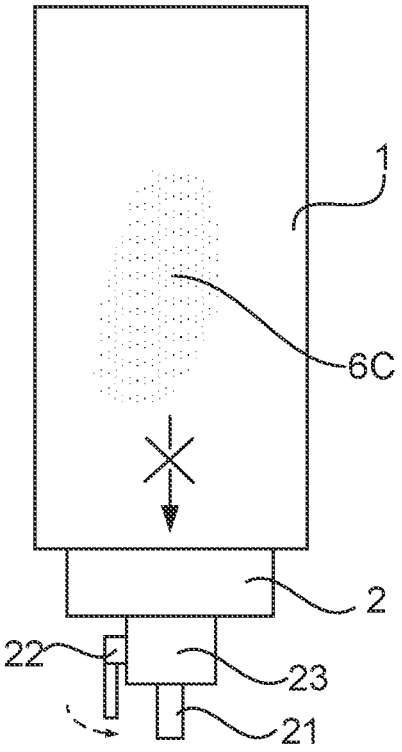
FIG. 12 is a schematic view of the first kind of sealed assembly for pill crushing and delivering having residual pill powders, of the present disclosure.
Figure 13:
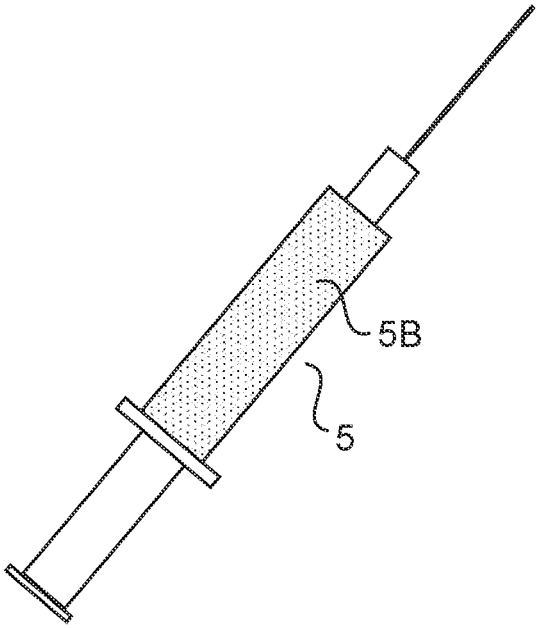
FIG. 13 is a schematic view of the first kind of sealed assembly for pill crushing and delivering when the syringe is loaded with the powder-dissolved injection liquid, of the present disclosure.

FIG. 10 is a schematic view of the first kind of sealed assembly for pill crushing and delivering when powder-dissolved injection liquid is extracted using the syringe, of the present disclosure. FIG. 11 is a schematic view of the first kind of sealed assembly for pill crushing and delivering when a filter screen filters pill fragments during the extraction of the injection liquid, of the present disclosure. FIG. 12 is a schematic view of the first kind of sealed assembly for pill crushing and delivering having residual pill powders, of the present disclosure. FIG. 13 is a schematic view of the first kind of sealed assembly for pill crushing and delivering when the syringe is loaded with the powder-dissolved injection liquid, of the present disclosure.

As shown in FIGS. 4-13, the present disclosure provides a method for using the sealed assembly for pill crushing and delivering, using the above sealed assembly, the method includes the following steps.

As shown in FIG. 4, the pill-crushing carrier 1 and the connecting valve 2 are separated in a way of thread unscrewing, to expose the filling-in opening of the pill-crushing carrier 1.

As shown in FIG. 5, a pill 6 is filled into the pill-crushing carrier 1 through the filling-in opening. At this time, the pill-crushing carrier 1 is in the first state, and the filling-in opening can be used for delivering pills into the sealed cavity.

As shown in FIG. 6, the filling-in opening of the pill-crushing carrier 1 is screwed to the connecting valve 2, using a valve plate 22 to keep the valve 23 closed to seal the pill-crushing carrier 1.

As shown in FIG. 7, the pill 6 is crushed in the pill-crushing carrier 1 into powders 6A using a pill crusher (such as a crushing hammer or a crushing pressing plate), wherein the powders 6A are kept in the inner cavity of the pill-crushing carrier 1 all the time as the valve 23 is kept closed and the pill-crushing carrier 1 is kept sealed.

As shown in FIG. 8, the syringe 5 is connected to the syringe-abutting interface 21 on the second end of the connecting valve 2, wherein the syringe 5 is loaded with injection liquid 5A. The filling-in opening can be used as a channel for liquid flowing into or out of the sealed cavity.

As shown in FIG. 9, after the syringe 5 is connected to the syringe-abutting interface 21, the valve 23 is opened by the valve plate 22, the injection liquid 5A in the syringe 5 is pushed into the pill-crushing carrier 1 to dissolve the powders 6A, and the powder-dissolved injection liquid 6B in the pill-crushing carrier 1 is formed. The powder-dissolved injection liquid 6B may include pill fragments 6D. In a preferable embodiment, after the pill is filled in the pill-crushing carrier and the pill-crushing carrier is screwed to the connecting valve, the pill-crushing carrier is pressed to exhaust a part of air and then the valve is kept closed to seal the pill-crushing carrier and keep a certain negative pressure in the pill-crushing carrier, the outer walls of the pill-crushing carrier are fitted with each other, and inner pressure and outer pressure of the sealed cavity are kept in a controllable state, to facilitate the crushing of the pill into powders and the extracting of the pill solution.

As shown in FIG. 10, the powder-dissolved injection liquid 6B is extracted from pill-crushing carrier 1 using the syringe 5, and at this time, the inner wall of the pill-crushing carrier 1 will be left with some residual pill powders 6C.

As shown in FIG. 11, during the process of extracting the powder-dissolved injection liquid 6B to the syringe 5, the residual pill fragments 6D generated by incomplete crushing can be filtered out by the filter screen 27 and blocked in the connecting valve 2, to prevent the pill fragments from falling into the syringe 5 and blocking the syringe 5.

As shown in FIG. 12, the valve is closed, and then the syringe 5 and the connecting valve 2 are separated, the residual pill powders 6C are kept on the inner wall of the pill-crushing carrier 1 all the time and will not disperse outside the pill-crushing carrier 1.

As shown in FIG. 13, the syringe 5 is loaded with powder-dissolved injection liquid 5B (pure solution without the pill fragments), and the syringe 5 can be connected to a syringe needle for injection.

Figure 14:
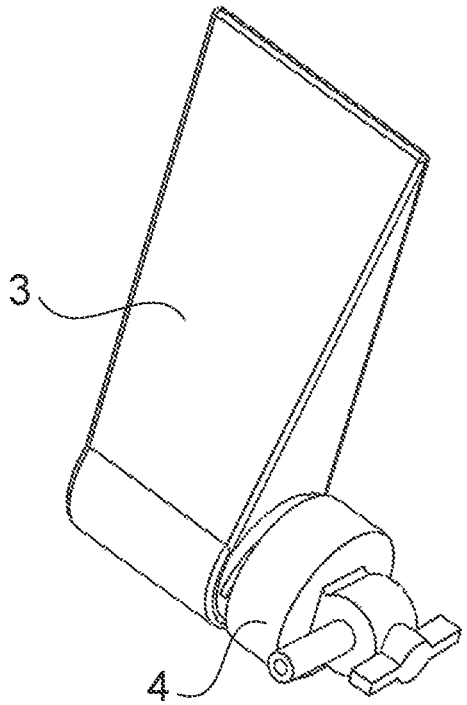
FIG. 14 is a stereogram of a second kind of sealed assembly for pill crushing and delivering of the present disclosure.
Figure 15:
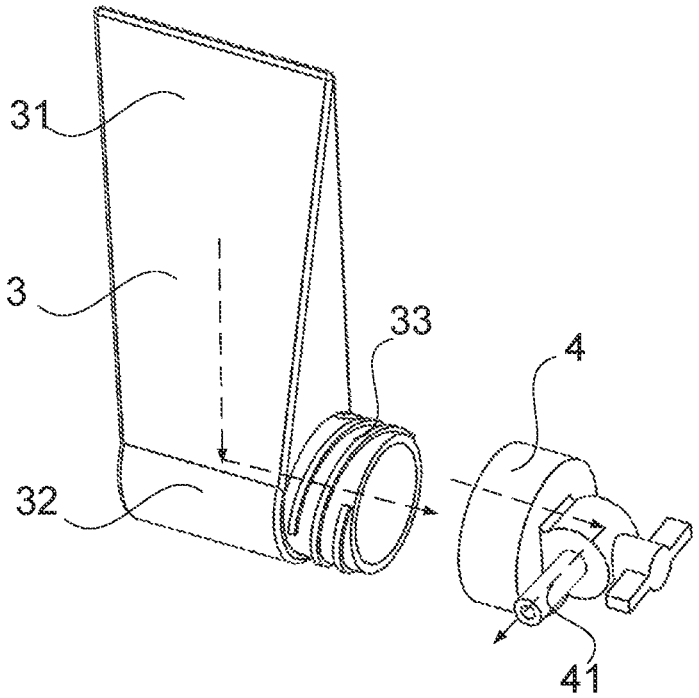
FIG. 15 is a decomposition view of the second kind of sealed assembly for pill crushing and delivering of the present disclosure.
Figure 16:
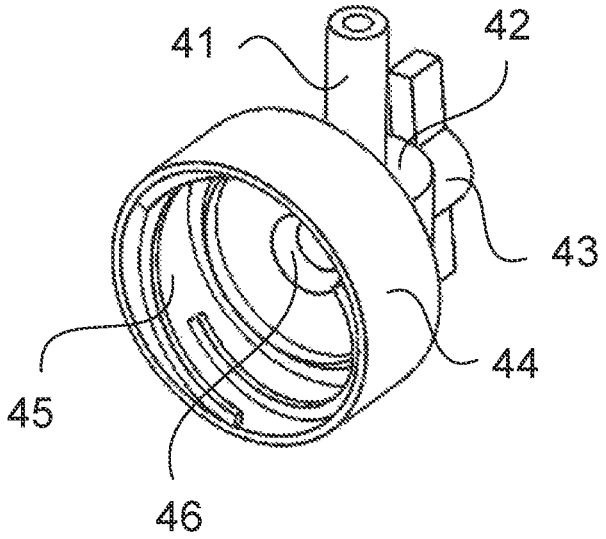
FIG. 16 is a stereogram of a connecting valve of the second kind of sealed assembly for pill crushing and delivering of the present disclosure.

FIG. 14 is a stereogram of a second kind of sealed assembly for pill crushing and delivering of the present disclosure. FIG. 15 is a decomposition view of the second kind of sealed assembly for pill crushing and delivering of the present disclosure. FIG. 16 is a stereogram of a connecting valve of the second kind of sealed assembly for pill crushing and delivering of the present disclosure. As shown in FIGS. 14-16, the second kind of sealed assembly for pill crushing and delivering of the present disclosure mainly includes a pill-crushing carrier 3 and a connecting valve 4 with different diameters. The pill-crushing carrier 4 includes a sealed side 31 and an opening side 32, and an outer threaded interface 33 is provided at the opening side 32. The connecting valve 4 includes a syringe-abutting interface 41 for a syringe, a valve plate 42, a valve 43, an inner threaded interface 44, inner thread 45, and a through hole 46. An opening diameter of the first end of the connecting valve 4 is larger than an opening diameter of the second end of the connecting valve 4. Similarly, the pill-crushing carrier 3 includes a flexible sealed cavity for crushing the pill to powders. The sealed cavity is provided with only one filling-in opening for delivering pills into the sealed cavity. The pill-crushing carrier 3 has a first state and a second state. When in the first state, the pill-crushing carrier 3 is separated from the connecting valve 4 and the filling-in opening is exposed for delivering pills into the sealed cavity, when in the second state, the filling-in opening is connected to the first end of the connecting valve 4. When the pill-crushing carrier 3 is in the second state and the syringe-abutting interface connecting valve is connected to a syringe, injection liquid in the syringe flows into or out of the pill-crushing carrier 3 through the connecting valve 4. A pill crusher is provided to express the pill-crushing carrier 3 loaded with the pill. The cooperate state of the pill-crushing carrier 3 and the connecting valve 4 of the present disclosure ensures not any part of powders disperse into the air during the pill crushing process, prevents harmful powders from damaging the health of medical workers or other patients. The pill-crushing carrier 1 can be sealed after used to ensure no leakage of residual pill powders after crushed. The main structure features, using principle and technical effects of the second kind of sealed assembly for pill crushing and delivering are similar to those of the first kind of sealed assembly for pill crushing and delivering, and the description thereof will be omitted here.

The difference between the second kind and the first kind of sealed assembly for pill crushing and delivering is: the opening side 32 of the pill-crushing carrier 3 forms a U-shaped groove, one side of the U-shaped groove is provided with the filling-in opening, an opening direction of the filling-in opening is perpendicular to an extruding direction of the extruding tube. Therefore, the injection liquid can be gathered and flows towards the filling-in opening, and the residual pill is reduced. But the present disclosure is not limited to this. An axial direction of the first end of the connecting valve 4 is perpendicular to an axial direction of the second end of the connecting valve 4. Therefore, the total length of the sealed assembly for pill crushing and delivering can be reduced to facilitate the operation of users, but the present disclosure is not limited to this.

The pill-crushing carrier 1 of the present disclosure can be a part not needed to be pressed. Therefore, the pill-crushing carrier 1 can be an extruding tube in a shape of a toothpaste tube (for example: a plastic soft tube body), or the pill-crushing carrier 1 can be a bottle body, to save the cost. But the present disclosure is not limited to this.

Figure 17:
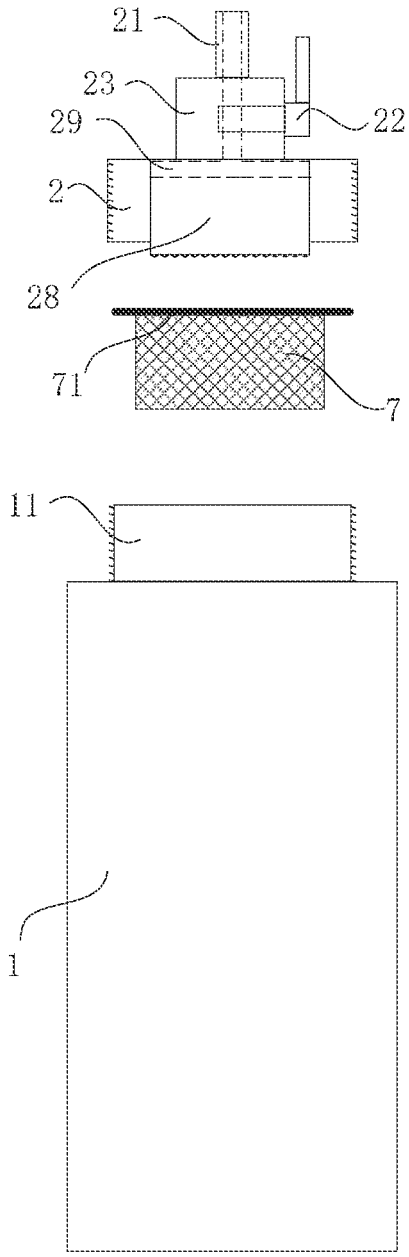
FIG. 17 is a schematic view of a third kind of sealed assembly for pill crushing and delivering in a separated state, of the present disclosure.

FIG. 17 is a schematic view of a third kind of sealed assembly for pill crushing and delivering in a separated state, of the present disclosure. As shown in FIG. 17, the present disclosure further provides a third kind of sealed assembly for pill crushing and delivering, including a pill-crushing carrier 1, a connecting valve 2 with different diameters, a syringe 5 and a support filter screen 7. The connecting valve 2 includes a first end and a second end along a connecting direction of the connecting valve 2. The second end of the connecting valve 2 is provided with a syringe-abutting interface 21. An opening diameter of the first end is larger than an opening diameter of the second end. A valve 23 is provided between the first end and the second end, to block or connect the connecting valve 2. The pill-crushing carrier 1 at least includes a sealed cavity for crushing the pill to powders. The sealed cavity is provided with only one filling-in opening for delivering pills into the sealed cavity. The pill-crushing carrier 1 has a first state and a second state. When is in the first state, the pill-crushing carrier 1 is separated from the connecting valve 2 and the filling-in opening is exposed for delivering pills into the sealed cavity, meanwhile, the filling-in opening can also be an outlet for directly pouring out the powders after the pill is crushed. When the pill-crushing carrier 1 is in the second state, the filling-in opening is connected to the first end of the connecting valve 2, liquid is injected to the sealed cavity from the second end of the connecting valve 2 to dissolve the powders and powder-dissolved injection liquid can be extracted out from the sealed cavity. The injected liquid can be water, physiological saline, or other suitable liquid. When the pill-crushing carrier 1 is in the second state, and the syringe 5 is abutted with the syringe-abutting interface 21, the injection liquid in the syringe 5 flows into or out of the pill-crushing carrier 1 through the connecting valve 2. An outer threaded interface 13 is provided at the filling-in opening, and an inner threaded interface 24 is provided on the first end of the connecting valve 2 to screw with the outer threaded interface 13. The pill-crushing carrier 1 is an extruding tube having a sealed side and an opening side opposite of the sealed side. The opening side is provided with the filling-in opening, an opening direction of the filling-in opening is the same as an extruding direction of the extruding tube, and an axial direction of the first end of the connecting valve 2 is the same as an axial direction of the second end of the connecting valve 2. A hanging edge 71 is provided on a periphery of the support filter screen 7, the hanging edge 71 is clamped between the filling-in opening of the pill-crushing carrier 1 and the first end of the connecting valve 2, so the support filter screen 7 is hanged within the scope of the sealed cavity of the pill-crushing carrier 1, to ensure that after the pill 6 is put in, the pill 6 is also within the scope of the sealed cavity of the pill-crushing carrier 1. Therefore, the powders generated by grinding the pill 6 will completely fall into the sealed cavity to the greatest extent.

In a preferable embodiment, the support filter screen 7 is integrally formed at the opening side of the pill-crushing carrier 1. With the third kind of sealed assembly for pill crushing and delivering, the process of pill crushing using a pill crusher (for example: pill crushing hammer or pill crushing pressing plate) to press the pill-crushing carrier 1 is transformed to the process of pill grinding by the cooperated rotation back and forth alternatively of the pill-crushing carrier 1 and the connecting valve 2, which can also realize pill crushing. With the third kind of sealed assembly for pill crushing and delivering, no external devices are needed any more, the using procedure is greatly simplified, and the humanized experience is improved.

In a preferable embodiment, the pipeline of the connecting valve 2 is no longer in a linear shape. The first end of the connecting valve 2 is provided with a grinding boss 28 that cooperates with the support filter screen 7 to grind the pills. A periphery of a bottom part of the grinding boss 28 is provided with at least one guiding branch tube 29 connected to the second end of the connecting valve 2. The support filter screen 7 is a barrel-shaped filter screen, and a periphery of the barrel-shaped filter screen extends outside to form the hanging edge 71. Grinding teeth are provided at one side of the grinding boss 28 facing the support filter screen 7. An extension direction of the guiding branch tube 29 is perpendicular to an axial direction of the second end of the connecting valve 2. Therefore, the powders generated by the pill grinding are prevented from blocking the pipeline of the connecting valve 2.

As shown in FIGS. 17-24, the present disclosure provides a method for using the above sealed assembly for pill crushing and delivering, including the following steps.

As shown in FIG. 17, the pill-crushing carrier 1, the support filter 7 and the connecting valve 2 are separated in a way of thread unscrewing.

Figure 18:
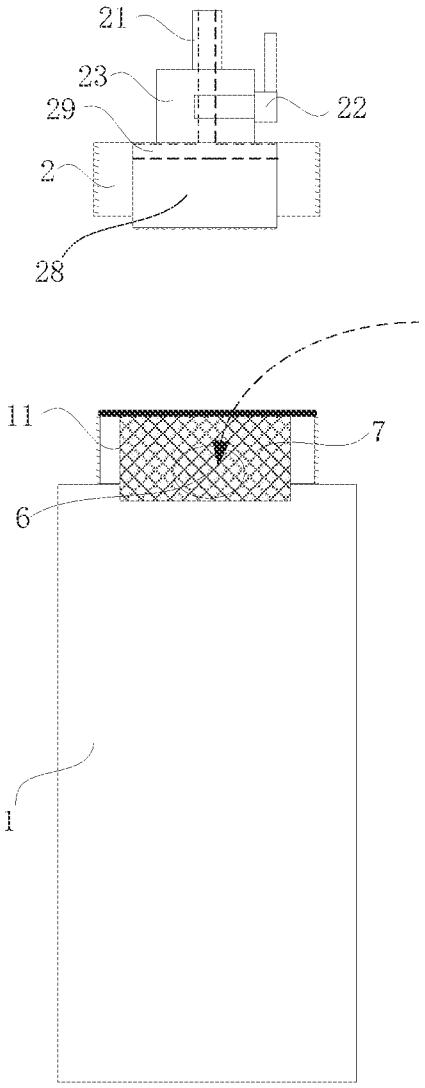
FIG. 18 is a schematic view of the third kind of sealed assembly for pill crushing and delivering when the pill is filled in after the assembly is in the separated state, of the present disclosure.

As shown in FIG. 18, the pill 6 is placed on the support filter screen 7. At this time, the pill-crushing carrier 1 is in the first state, and the filling-in opening can be used for delivering pills into the sealed cavity.

Figure 19:
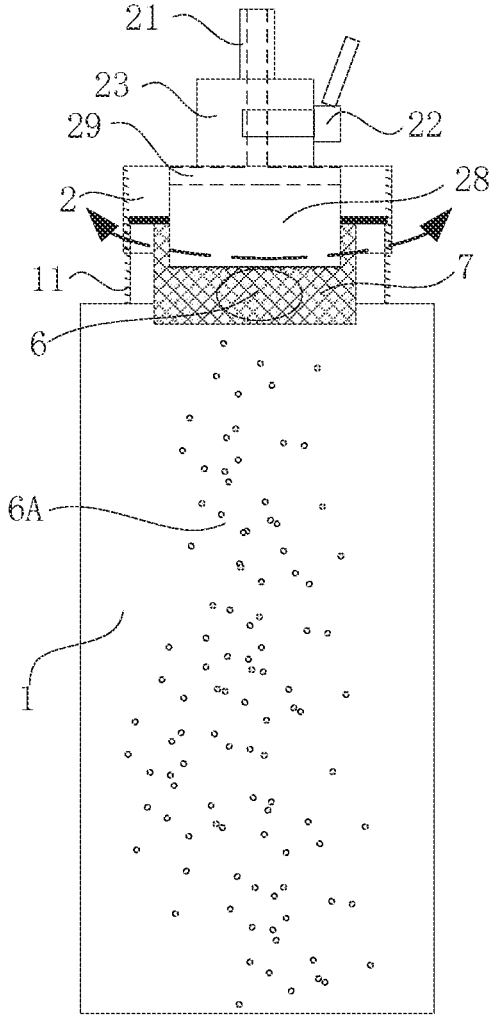
FIG. 19 is a schematic view of the third kind of sealed assembly for pill crushing and delivering when the pill is limited between the support filter screen and the connecting valve, of the present disclosure.

As shown in FIG. 19, the filling-in opening of the pill-crushing carrier 1 is screwed with the connecting valve 2, the support filter screen 7 loaded with the pill 6 is clamped between the pill-crushing carrier 1 and the connecting valve 2, and the valve 23 is kept closed. The pill-crushing carrier 1 and the connecting valve 2 are rotated back and forth alternately to make the grinding boss of the connecting valve grind the pill, the powders falls into the pill-crushing carrier through the filling-in opening.

Figure 20:
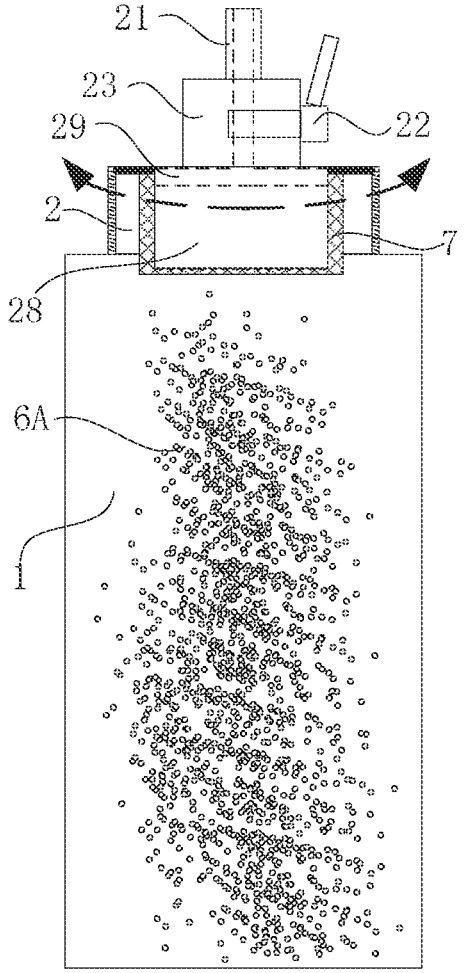
FIG. 20 is a schematic view of the third kind of sealed assembly for pill crushing and delivering when the connecting valve is rotated back and forth alternatively to grind the pill, of the present disclosure.

As shown in FIG. 20, when grinding the pill, the connecting valve 2 is at an upper part along the gravity direction, and the pill-crushing carrier 1 is at a lower part along the gravity direction. As the valve 23 is closed, the pill-crushing carrier 1 is sealed, the powders 6A are always kept in the inner cavity of the pill-crushing carrier 1. In the meantime, as the guiding branch tube 29 is at the bottom part of the grinding boss 28, the powders generated by the pill grinding will not disperse to the guiding branch tube 29. Therefore, the pipeline of the connecting valve 2 is always kept unblocked.

Figure 21:
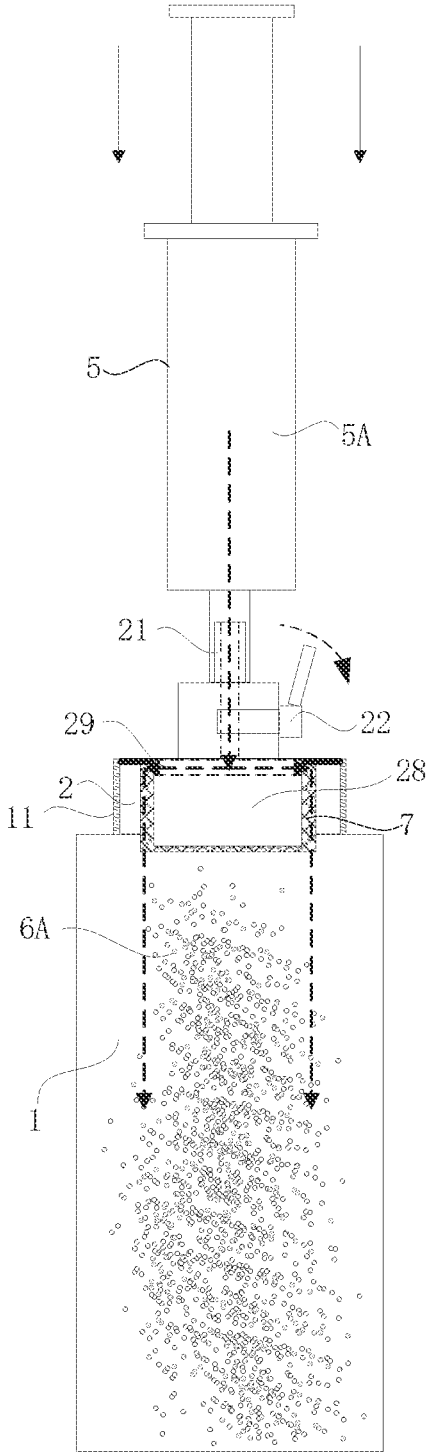
FIG. 21 is a schematic view of the third kind of sealed assembly for pill crushing and delivering when a syringe is connected, of the present disclosure.

As shown in FIG. 21, after the pill 6 in the support filter screen 7 is completely crushed into the powders 6A, the syringe 5 is connected to the syringe-abutting interface 21 on the second end of the connecting valve 2. The filling-in opening is used as a channel for liquid flowing into or out of the sealed cavity. The injection liquid 5A in the syringe 5 flows towards the pill-crushing carrier 1 through the connecting valve 2 from the syringe 5, along a direction shown as the dashed arrow in FIG. 21. After flowing through the syringe-abutting interface 21 on the second end of the connecting valve 2, the injection liquid 5A flows through the guiding branch tube 29 which is perpendicular to the axial direction of the syringe-abutting interface 21 and flows out from the bottom part of the grinding boss 28. Then the injection liquid 5A flows into the inner cavity through the first end of the connecting valve 2 and the support filter screen 7.

Figure 22:
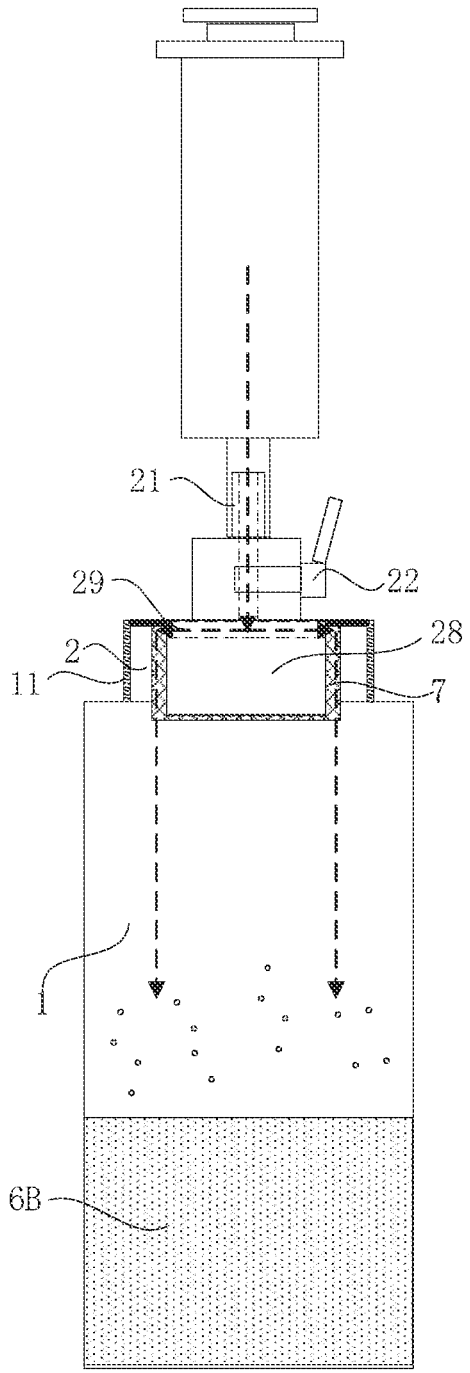
FIG. 22 is a schematic view of the third kind of sealed assembly for pill crushing and delivering when injection liquid is injected in to dissolve the powders after the syringe is connected, of the present disclosure.

As shown in FIG. 22, after the syringe 5 is connected to the syringe-abutting interface 21, the valve 23 is opened by the valve plate 22, to push the injection liquid in the syringe 5 into the pill-crushing carrier 1 to dissolve the powders 6A, therefore powder-dissolved injection liquid 6B is formed in the pill-crushing carrier 1.

Figure 23:
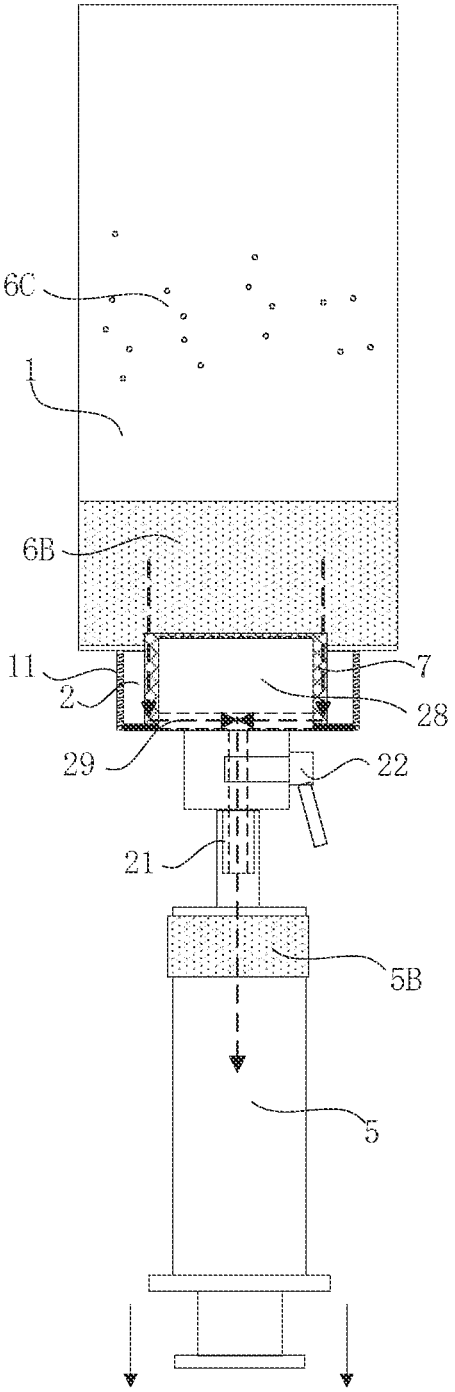
FIG. 23 is a schematic view of the third kind of sealed assembly for pill crushing and delivering when powder-dissolved injection liquid is extracted using the syringe, of the present disclosure.

As shown in FIG. 23, the powder-dissolved injection liquid 6B is extracted from the pill-crushing carrier 1 using the syringe 5. At this time, the inner wall of the pill-crushing carrier will be left with some residual pill powders 6C.

Figure 24:
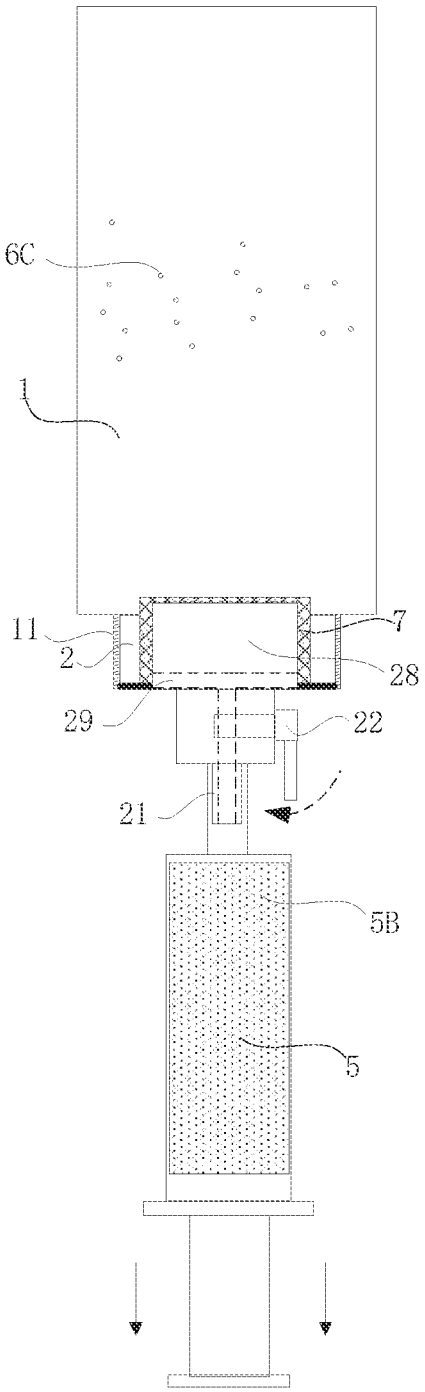
FIG. 24 is a schematic view of the third kind of sealed assembly for pill crushing and delivering when the valve is closed after the powder-dissolved injection liquid is extracted using the syringe, of the present disclosure.
Figure 25:
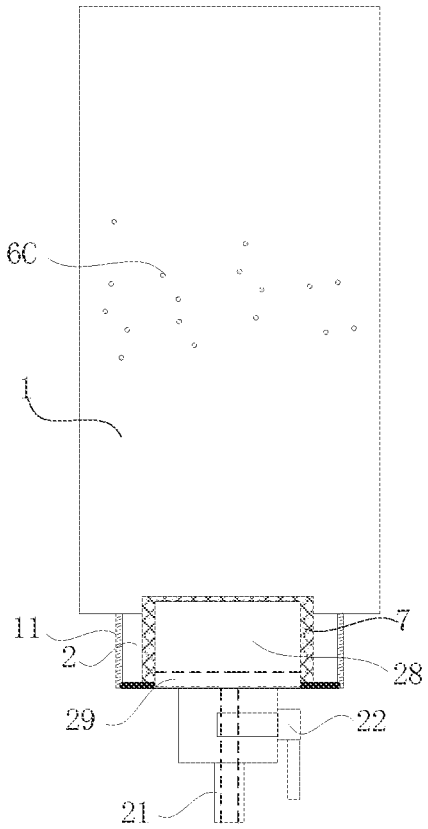
FIG. 25 is a schematic view of the third kind of sealed assembly for pill crushing and delivering having residual pill powders, of the present disclosure.
Figure 26:
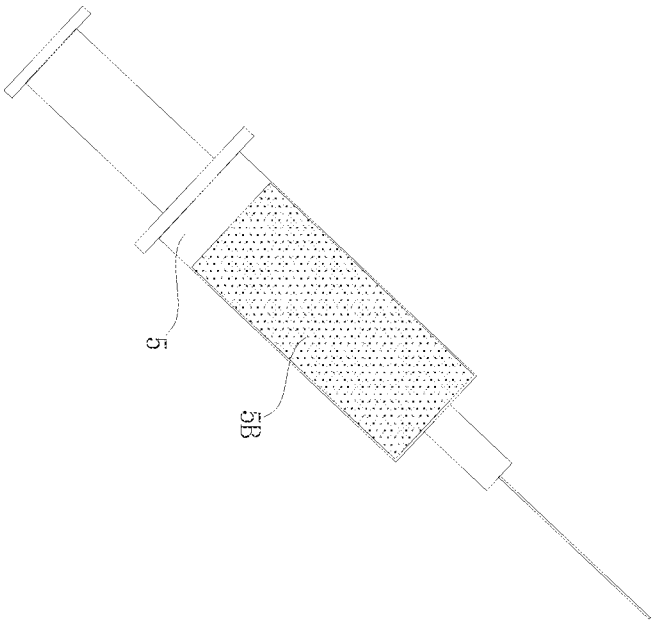
FIG. 26 is a schematic view of the third kind of sealed assembly for pill crushing and delivering when the syringe is loaded with the powder-dissolved injection liquid, of the present disclosure.

As shown in FIGS. 24-26, the valve is closed, and then the syringe 5 and the connecting valve 2 are separated from each other. The residual powder 6A will be kept in the inner wall of the pill-crushing carrier 1 all the time, and will not disperse outside the pill-crushing carrier 1. The syringe 5 is loaded with powder-dissolved injection liquid 6B, and the syringe 5 can be connected to a syringe needle for injection.

Figure 27:
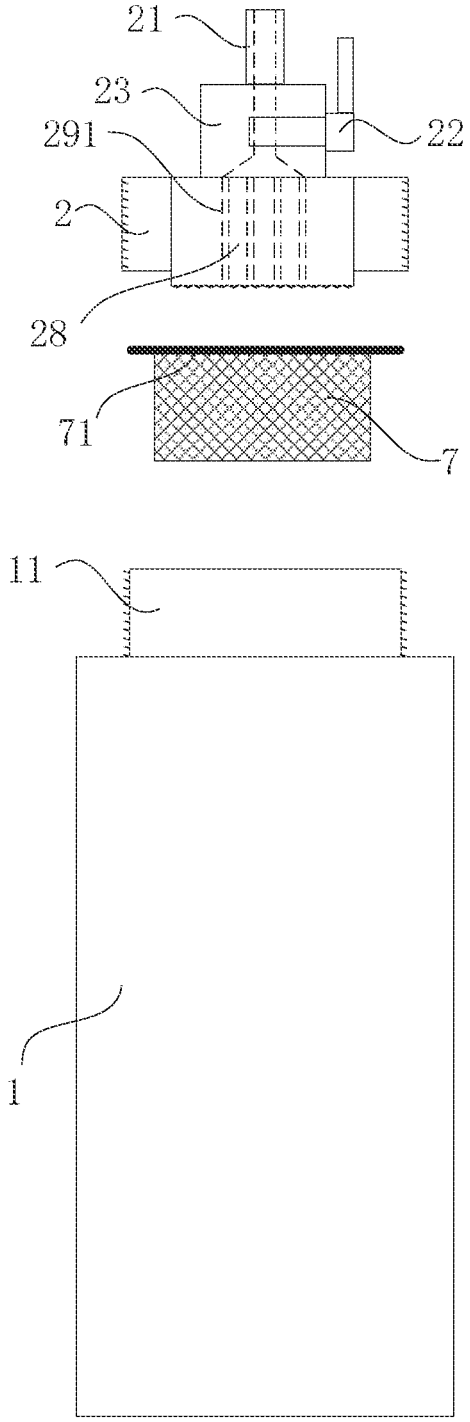
FIG. 27 is a schematic view of the third kind of sealed assembly for pill crushing and delivering in the separated state, of the present disclosure.

FIG. 27 is a schematic view of the third kind of sealed assembly in the separated state, of the present disclosure. As shown in FIG. 27, the present disclosure further provides a third kind of sealed assembly for pill crushing and delivering, including a pill-crushing carrier 1, a connecting valve 2, a syringe 5 and a support filter screen 7. The connecting valve 2 includes a first end and a second end along a connecting direction of the connecting valve 2. The second end of the connecting valve 2 is provided with a syringe-abutting interface 21. An opening diameter of the first end is larger than the opening diameter of the second end. A valve 23 is provided between the first end and the second end, to block or connect the connecting valve 2. The pill-crushing carrier 1 at least includes a sealed cavity for crushing the pill to powders. The sealed cavity is provided with only one filling-in opening for delivering pills into the sealed cavity. The pill-crushing carrier 1 has a first state and a second state. When the pill-crushing carrier 1 is in the first state, the pill-crushing carrier 1 is separated from the connecting valve 2 and the filling-in opening is exposed for delivering pills into the sealed cavity, meanwhile, the filling-in opening can also be an outlet for directly pouring out the powders after the pill is crushed. When the pill-crushing carrier 1 is in the second state, the filling-in opening is connected to the first end of the connecting valve 2, liquid is injected to the sealed cavity from the second end of the connecting valve 2 to dissolve the powders and the powder-dissolved injection liquid can be extracted out from the sealed cavity. The injected liquid can be water, physiological saline, or other suitable liquid. When the pill-crushing carrier is in the second state, and the syringe 5 is abutted with the syringe-abutting interface 21, the injection liquid in the syringe 5 flows into or out of the pill-crushing carrier 1 through the connecting valve 2. An outer threaded interface 13 is provided at the filling-in opening, and an inner threaded interface 24 is provided on the first end of the connecting valve 2 to screw with the outer threaded interface 13. The pill-crushing carrier 1 is an extruding tube having a sealed side and an opening side. The opening side is provided with the filling-in opening, an opening direction of the filling-in opening is the same as an extruding direction of the extruding tube, and an axial direction of the first end of the connecting valve 2 is the same as an axial direction of the second end of the connecting valve 2. A hanging edge 71 is provided on a periphery of the support filter screen 7, the hanging edge 71 is clamped between the filling-in opening of the pill-crushing carrier 1 and the first end of the connecting valve 2, so the support filter screen 7 is hanged within the scope of the sealed cavity of the pill-crushing carrier 1, to ensure that after the pill 6 is put in, the pill 6 is also within the scope of the sealed cavity of the pill-crushing carrier 1. Therefore, the powders generated by grinding the pill 6 will completely fall into the sealed cavity to the greatest extent. In the embodiment, an end surface of the grinding boss 28 facing the support filter screen 7 is provided with a plurality of openings respectively connected to a plurality of linear-type tubes 291 on the second end of the connecting valve 2, to accelerate the flowing speed of the injection liquid in the connecting valve 2. Other features of the sealed assembly are similar to those described above, and the description will be omitted here.

Above all, in the present disclosure, the pill can be crushed, dissolved and transferred by a syringe within a same sealed space, by the transfer of the syringe, the pill can be delivered adjunctively into mouth, the digestive tract, or an enteral nutrition pipeline in an injection form. The assembly of the present disclosure is easy to operate, and has no contamination. During the whole process of pill crushing, powders dissolving and powder-dissolved injection liquid transferring, the powders will not disperse, to protect the health of medical workers.

The above is a detailed description of the present disclosure in connection with the specific preferred embodiments, and the specific embodiments of the present disclosure are not limited to the description. Modifications and substitutions can be made without departing from the spirit and scope of the present disclosure.

What is claimed is:

1. A sealed assembly for pill crushing and delivering comprising:

a connecting valve with different diameters, comprising a first end and a second end along a connecting direction of the connecting valve, wherein, the second end is provided with a syringe-abutting interface, an opening diameter of the first end is larger than an opening diameter of the second end, and a valve is provided between the first end and the second end, to block or connect fluid communication between the first end and the second end;

a pill-crushing carrier at least comprising a sealed cavity, wherein the sealed cavity is provided with only one filling-in opening for delivering pills into the sealed cavity, the pill-crushing carrier has a first state and a second state, when in the first state, the pill-crushing carrier is separated from the connecting valve and the filling-in opening is exposed for delivering pills into the sealed cavity, when in the second state, the filling-in opening is connected to the first end of the connecting valve, crushed and dissolved pill powders in the sealed cavity can be taken out from the second end of the connecting valve; and a support filter screen, a hanging edge is provided on a periphery of the support filter screen, the hanging edge is clamped between the filling-in opening of the pill-crushing carrier and the first end of the connecting valve, the first end of the connecting valve is provided with a grinding boss that cooperates with the support filter screen to grind the pills.

2. The assembly of claim 1, wherein, the assembly further comprises a syringe, when the syringe is abutted with the syringe-abutting interface, injection liquid in the syringe flows into or out of the pill-crushing carrier through the connecting valve.

3. The assembly of claim 1, wherein, an outer threaded interface is provided at the filling-in opening, an inner threaded interface is provided on the first end of the connecting valve, the internal threaded interface and the external threaded interface are screwed to each other.

4. The assembly of claim 1, wherein, the pill-crushing carrier is an extruding tube having a sealed side and an opening side opposite of the sealed side, the filling-in opening is provided at the opening side, an opening direction of the filling-in opening is the same as an extruding direction of the extruding tube, an axial direction of the first end of the connecting valve is the same as an axial direction of the second end of the connecting valve.

5. The assembly of claim 1, wherein, a periphery of a bottom part of the grinding boss is provided with at least one guiding branch tube connected to the second end of the connecting valve.

6. The assembly of claim 5, wherein, an extension direction of the guiding branch tube is perpendicular to an axial direction of the second end of the connecting valve.

7. The assembly of claim 1, wherein, grinding teeth are provided at one side of the grinding boss facing the support filter screen.

8. The assembly of claim 1, wherein, the support filter screen is a barrel-shaped filter screen, a periphery of the barrel-shaped filter screen extends outside to form the hanging edge.

9. The assembly of claim 1, wherein, an end surface of the grinding boss facing the support filter screen is provided with a plurality of openings respectively connected to a plurality of linear-type tubes on the second end of the connecting valve.

10. A method for using the assembly of claim 1, comprising the following steps:

placing at least one pill on the support filter screen;

screwing the filling-in opening of the pill-crushing carrier to the connecting valve, clamping the support filter screen loaded with the pill between the pill-crushing carrier and the connecting valve, and keeping the valve closed;

rotating the pill-crushing carrier and the connecting valve back and forth alternately to make the grinding boss of the connecting valve grind the pill, and powders of the ground pill fall into the pill-crushing carrier through the filling-in opening;

connecting a syringe to the second end of the connecting valve, opening the valve, and pushing an injection liquid from the syringe to the pill-crushing carrier, to dissolve the powders;

extracting powder-dissolved injection liquid from the pill-crushing carrier using the syringe, and then separating the pill-crushing carrier and the connecting valve.

11. The method of claim 10, wherein, when grinding the pill, the connecting valve is at an upper part along the gravity direction, and the pill-crushing carrier is at a lower part along the gravity direction.

12. The method of claim 10, wherein, after extracting the powder-dissolved injection liquid from the pill-crushing carrier using the syringe, closing the valve before separating the pill-crushing carrier and the connecting valve.

* * * * *